US007406951B2

(12) United States Patent
Stoecklein

(10) Patent No.: US 7,406,951 B2
(45) Date of Patent: Aug. 5, 2008

(54) FUEL INJECTOR WITH VARIABLE ACTUATOR BOOSTING

(75) Inventor: Wolfgang Stoecklein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/596,916

(22) PCT Filed: Apr. 15, 2005

(86) PCT No.: PCT/EP2005/051682

§ 371 (c)(1),
(2), (4) Date: Nov. 17, 2006

(87) PCT Pub. No.: WO2005/121544

PCT Pub. Date: Dec. 22, 2005

(65) Prior Publication Data

US 2007/0246019 A1 Oct. 25, 2007

(30) Foreign Application Priority Data

Jun. 8, 2004 (DE) ..... 10 2004 027 824

(51) Int. Cl.
*F02M 37/04* (2006.01)
*B05B 1/06* (2006.01)

(52) U.S. Cl. ..... 123/498; 239/102.2

(58) Field of Classification Search ..... 123/498, 123/467, 472, 478; 239/102.2, 533.4, 88–92; 251/129.01, 57, 129.06
See application file for complete search history.

(56) References Cited

U.S. PATENT DOCUMENTS

| | | | | |
|---|---|---|---|---|
| 5,697,554 | A | 12/1997 | Auwaerter et al. | |
| 6,240,905 | B1 | 6/2001 | Boecking | |
| 6,302,333 | B1 | 10/2001 | Hoffmann et al. | |
| 6,457,699 | B1 | 10/2002 | Stoecklein | |
| 6,561,436 | B1 * | 5/2003 | Boecking | 239/102.2 |
| 6,588,678 | B1 * | 7/2003 | Mattes | 239/102.2 |
| 6,805,302 | B2 * | 10/2004 | Boecking | 239/102.2 |
| 2002/0139946 | A1 * | 10/2002 | Stoecklein et al. | 251/57 |
| 2002/0162900 | A1 * | 11/2002 | Boecking | 239/102.2 |
| 2003/0062026 | A1 * | 4/2003 | Boecking | 123/446 |
| 2003/0085371 | A1 * | 5/2003 | Mattes | 251/57 |
| 2003/0098428 | A1 * | 5/2003 | Mattes | 251/57 |
| 2004/0069963 | A1 | 4/2004 | Mattes et al. | |
| 2006/0208107 | A1 * | 9/2006 | Heinz | 239/533.2 |

FOREIGN PATENT DOCUMENTS

| | | | |
|---|---|---|---|
| DE | 195 00 706 | A1 | 7/1996 |
| DE | 198 17 320 | C1 | 11/1999 |
| DE | 198 35 494 | A1 | 2/2000 |
| DE | 199 46 827 | C1 | 6/2001 |
| DE | 101 47 483 | A1 | 4/2003 |

* cited by examiner

*Primary Examiner*—Mahmoud Gimie
(74) *Attorney, Agent, or Firm*—Ronald E. Greigg

(57) ABSTRACT

The invention relates to a fuel injector for injecting fuel into the combustion chamber of an internal combustion engine. The fuel injector has an injection valve member that can be actuated directly by a piezoelectric actuator. This injection valve member is contained in a nozzle body of the fuel injector and can be moved into its closed position by a spring element. A hydraulic boosting device is provided between the piezoelectric actuator and the injection valve member in order to adapt the force to be exerted by the piezoelectric actuator to the opening force curve of the injection valve member.

11 Claims, 3 Drawing Sheets

FUEL INJECTOR WITH VARIABLE ACTUATOR BOOSTING

CROSS-REFERENCE TO RELATED APPLICATIONS

This application is a 35 USC 371 application of PCT/EP 2005/051682 filed on Apr. 15, 2005.

BACKGROUND OF THE INVENTION

1. Field of the Invention

Internal combustion engines are supplied with fuel by means of fuel injection systems that have a number of fuel injectors. Modern autoignition engines use high-pressure accumulator fuel injection systems. The fuel injectors, which can each be supplied with fuel by means of a high-pressure fuel accumulator (common rail), are triggered by means of solenoid valves or piezoelectric actuators. In fuel injectors whose actuating element is embodied in the form of a piezoelectric actuator, a needle-shaped injection valve member can be directly controlled by changing the electrical voltage supplied to the piezoelectric actuator. When the piezoelectric actuator is supplied with current, the piezocrystal stack undergoes a longitudinal extension that disappears again when the current is switched off.

2. Description of the Prior Art

In fuel injectors that are actuated by means of a piezoelectric actuator, the piezocrystal stack undergoes a longitudinal extension when supplied with current. Depending on the strength of the current supply, the piezocrystal stack of the piezoelectric actuator lengthens by a different amount. When the current is switched off again, though, the piezocrystal stack reverts back to its original length. It has turned out that supplying different current levels to the piezocrystal stack of a piezoelectric actuator is only able to achieve insufficiently stable intermediate positions of an injection valve member, which can be embodied in the form of a nozzle needle.

If a piezoelectric actuator is used in a fuel injector with a directly controlled injection valve member, then the required intermediate positions of the injection valve member between its completely open position and its completely closed position can only be maintained to a degree that is not sufficiently stable, which can be accompanied by a significant variation in the quantity of fuel injected into the combustion chamber of the autoignition engine in an intermediate position of the injection valve member.

In fuel injectors with direct needle control, in order to be able to open an injection valve member by means of a piezoelectric actuator, it is first necessary to overcome powerful forces. The injection valve member embodied in the form of a nozzle needle is usually pressed into its seat by system pressure, i.e. by rail pressure in the case of common rail injection systems. These forces can be on the order of 100 N. In order to be able to supply a sufficient flow of fuel through the fuel injector when the injection valve member is completely open, it is necessary for the injection valve member to execute a stroke of several hundred μm, e.g. on the order of between 200 and 300 μm. The values of the maximum opening force $F_{max}$, which can be in the range of several hundred N, e.g. 400 N, and the maximum stroke distance of the injection valve member on the order of between 200 and 300 μm essentially determine the size of the piezoelectric actuator that is used to directly actuate the fuel injector.

By implementing a for example hydraulically functioning boosting action, it is in fact possible to vary the length/diameter ratio of the piezoelectric actuator; by itself, the volume of the actuator is determined by the maximum opening force $F_{max}$ to be overcome and by the maximum stroke distance to be executed by the injection valve member, which can be embodied in the form of a needle.

SUMMARY OF THE INVENTION

The embodiment proposed by the invention adapts the force produced by the piezoelectric actuator to the seat forces of the injection valve member by means of a for example two-stage boosting of the opening force curve. In the case of an injection valve member that is acted on by system pressure, in order to open the injection valve member, which can be embodied in the form of a needle, the adaptation of the opening force curve proposed according to the invention provides a powerful force that is able to move the injection valve member out of its seated position. In order to then bring about a complete opening of the needle-shaped injection valve member, the boosting changes once the piezoelectric actuator has traveled a certain amount of its stroke distance.

The multistage boosting of the force generated by the piezoelectric actuator proposed by the invention can also be advantageously used to achieve a stable intermediate stroke stop for the injection valve member. Intermediate stroke positions of the injection valve member between a stop defining its closed position and a stop defining its open position, i.e. the maintaining of a ballistic position of the injection valve member, are considered to be particularly critical for the achievement of small fuel volumes to be injected into the combustion chamber of the autoignition engine. The embodiment proposed according to the present invention, a two-stage or multistage boosting of the force produced by the piezoelectric actuator, can reliably achieve ballistic intermediate stroke positions of the injection valve member of the fuel injector and maintain them in a stable fashion.

BRIEF DESCRIPTION OF THE DRAWINGS

The invention will be explained in detail below in conjunction with the drawings, in which.

DESCRIPTION OF THE PREFERRED EMBODIMENTS

Figure 1:
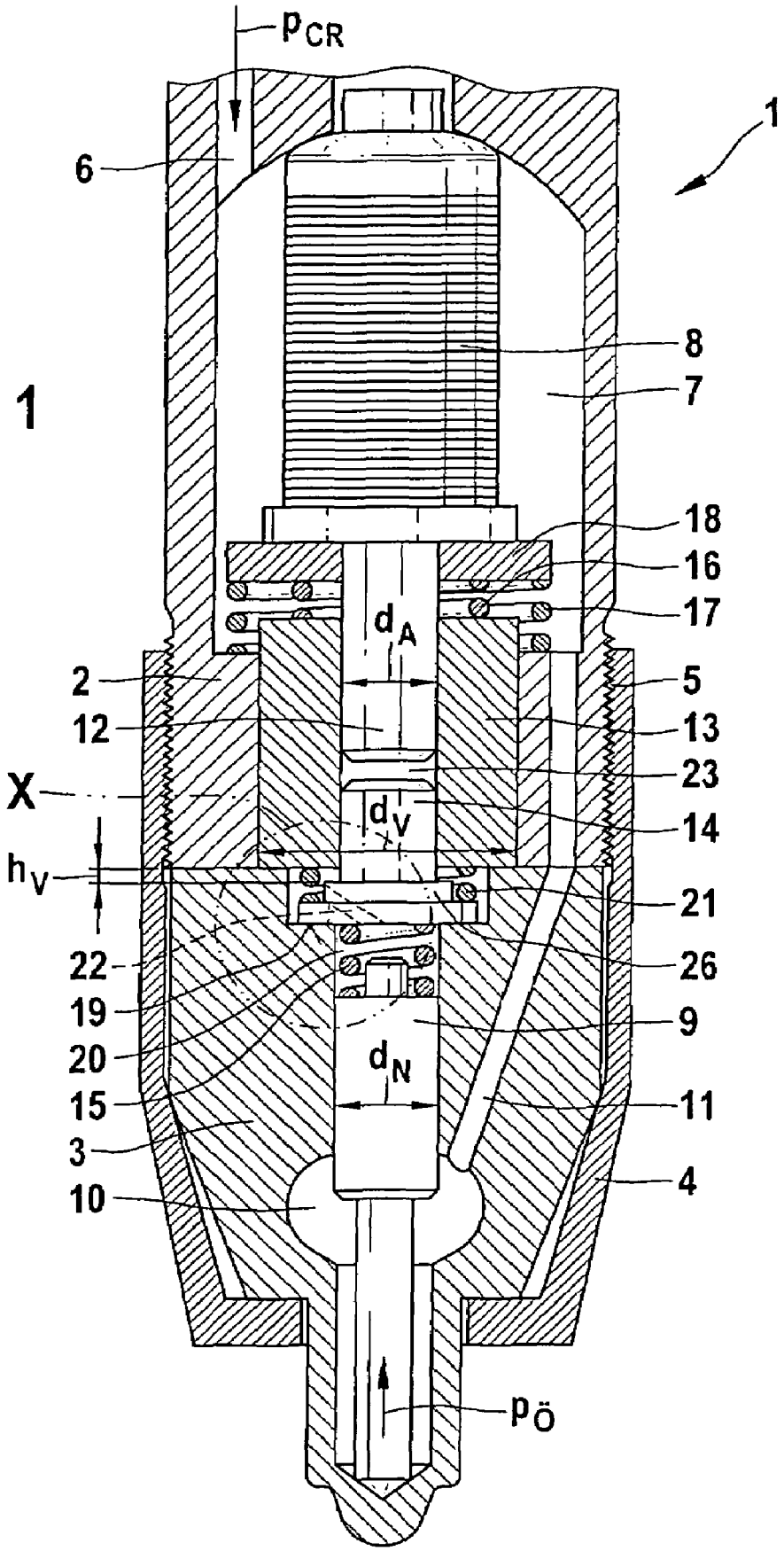
FIG. 1 shows a fuel injector with direct control of the injection valve member and a booster piston coupled inside a prestroke sleeve, FIG. 1.1 is a larger scale view of detail X of FIG. 1 showing one of the booster pistons with a connecting bore contained in it, FIG. 1.2 schematically depicts the seat of the injection valve member oriented toward the combustion chamber.

FIG. 1 is a longitudinal section through a fuel injector according to the present invention, with direct control of the injection valve member and a variable boosting of the stroke path of a piezoelectric actuator.

A fuel injector 1 includes an injector body 2 that is also referred to as a holding body. A retaining nut 4 attaches the injector body 2 of the fuel injector 1 to a nozzle body 3 at a screw connection 5. The injector body 2 has a high-pressure connection 6 that acts on a cavity 7 contained in the injector body 2 with system pressure, e.g. the fuel pressure level prevailing in a high-pressure accumulator (common rail).

From the cavity 7 of the injector body 2, a nozzle chamber inlet 11 extends to a nozzle chamber 10 contained in the nozzle body 3 and encompassing a needle-shaped injection valve member 9. In the region of the nozzle chamber 10, which is likewise acted on by system pressure, a pressure shoulder is formed onto the injection valve member 9, which can be embodied in the form of a needle. The system pressure prevailing in the pressure chamber 10 acts on the needle-shaped injection valve member 9 in the opening direction.

The cavity 7 of the injector body 2 contains a piezoelectric actuator 8 depicted only schematically in FIG. 1. containing a multitude of piezocrystals stacked one on top of another, which extend in the longitudinal direction when the piezoelectric actuator 8 is supplied with current. This causes the piezoelectric actuator 8 inside the cavity 7 of the injector body 2 to expand in the vertical direction, thus supplying the forces necessary to actuate the injection valve member 9. But if the supply of current to the piezoelectric actuator 8 is interrupted, then the individual piezocrystals stacked one on top of another in the vertical direction revert back to their original length in the vertical direction so that the piezoelectric actuator 8 as a whole once again assumes its original length.

FIG. 1 shows that a prestroke sleeve 13 encompasses both a first piston 12 and a second piston 14. The face-to-face ends of the first piston 12 and second piston 14 and the prestroke sleeve 13 encompassing the two pistons 12 and 14 delimit a hydraulic coupling chamber 23. The outer diameter of the prestroke sleeve is labeled $d_v$.

The first piston 12 is attached to a disk-shaped stop 18 that rests against the underside of the piezoelectric actuator 8. The disk-shaped stop 18 acts on both an inner spring element 16 and an outer spring element 17 that can be embodied, for example, as a coil springs. The inner spring element 16 rests against the prestroke sleeve 13 at one end, while the outer spring element 17 rests against a surface of the injector body 2, which in turn encompasses the prestroke sleeve 13. With their end surfaces oriented away from the piezoelectric actuator 8, both the injector body 2 and the prestroke sleeve 13 rest against an upper flat surface of the nozzle body 3 along a parting line. The diameter of the first piston 12 is labeled $d_A$.

According to the depiction in FIG. 1, the nozzle body 3 of the fuel injector 1 contains a cavity (unnumbered) underneath the prestroke sleeve 13. This cavity accommodates the second piston 14 whose narrowed end protrudes into the prestroke sleeve 13 and is situated on the opposite side of a coupling chamber 23 from the first piston 12. The second piston 14 is acted on by an additional spring element 21, which rests against a collar of the second piston 14 at one end and at the other end, rests against the lower end surface of the prestroke sleeve 13 above a cavity in the nozzle body 3. A schematically depicted bore 22 hydraulically connects the cavity to a control chamber 20 that is acted on by a piston end surface 19 of the second piston 14. In the depiction according to FIG. 1, the piston end surface 19 rests against a flat surface of the nozzle body 3 above the injection valve member 9.

The second piston 14 is situated above the control chamber 20, which contains a control chamber spring element 15. The control chamber spring element 15 rests against the piston end surface 19 of the second piston 14 at one end and at the other end, rests against an end surface of the needle-shaped injection valve member 9. The diameter of the needle-shaped injection valve member 9 above the nozzle chamber 10 is labeled $d_N$.

Detail X (FIG. 1.1) shows that the bore 22 hydraulically connects the cavity in the upper region of the nozzle body 3 of the fuel injector 1 according to the depiction in FIG. 1 to the control chamber 20 delimited by the piston end surface 19 of the second piston 14. In lieu of the bore 22 shown, the hydraulic connection can also be embodied in the form of grooves or recesses embodied in some other way on the circumferential surface of the second piston 14. The reference label $h_V$ indicates a definite distance between the lower end of the prestroke sleeve 13 and a collar 26 on the second piston 14.

Initially the control chamber spring element 15 presses the injection valve member 9, which can be embodied in the form of a needle, into the nozzle seat, thus closing the injection openings, not shown in FIGS. 1 and 1.1, via which fuel can be injected into the combustion chamber of the autoignition engine. The additional spring element 21—contained in the cavity of the nozzle body 3—presses the second piston 14 downward against a flat surface in the nozzle body 3. The piston end surface 19 of the second piston 14 rests against this flat surface. The spring force of the additional spring element 21 contained in the cavity of the nozzle body 3 exceeds the spring force of the control chamber spring element 15. At the same time, the inner spring element 16 presses the prestroke sleeve 13 against the upper end surface of the nozzle body 3. This position represents the initial position of the prestroke sleeve 13. In this state, the lower end surface of the prestroke sleeve 13 and the collar 26 on the circumference of the second piston 14 are spaced apart by the distance labeled $h_V$ in FIG. 1 and in Detail X (FIG. 1.1).

In this state, it is assumed that the piezoelectric actuator 8 is being supplied with current, i.e. a voltage is being applied to its piezocrystals and these have therefore elongated in the vertical direction.

If the current supply to the piezoelectric actuator 8 is reduced, then the shrinking length of the piezocrystals of the piezoelectric actuator 8 causes the first piston 12 to retract from the hydraulic coupling chamber 23. As a result, the pressure in the hydraulic coupling chamber 23 decreases. The second piston 14 reacts to the pressure change in the hydraulic coupling chamber 23 and moves synchronously with the piezoelectric actuator 8. The vertical movement of the second piston 14 reduces the pressure in the control chamber 20. The further the current supply to the piezoelectric actuator 8 is reduced, the further the pressure in the control chamber 20 falls. If a critical pressure has been reached, i.e. the pressure has reached an opening pressure $P_O$ of the injection valve member 9 that can be embodied in the form of a needle, then this valve member 9 opens. The nozzle seat diameter $d_S$ (see FIG. 1.2), the system pressure $P_{CR}$, and the diameter $d_N$, i.e. the diameter of the injection valve member 9 that can be embodied in the form of a needle, determine the opening pressure $P_O$ at which the injection valve member 9 begins to open, in accordance with the following relation:

$$p_O = P_{CR}(d_N^2 - d_S^2)/d_N^2, \text{ where}$$

$P_{CR}$=system pressure $d_N$=diameter of injection valve member 9

$d_S$=seat diameter.

The spring forces acting on the injection valve member 9 have been disregarded here for the sake of simplicity.

During the opening phase, the effective piston diameter with which the piezoelectric actuator 8 generates a vacuum in the control chamber 20 is the diameter $d_A$, i.e. the diameter of the first piston 12. This means that between the piezoelectric actuator 8 and the needle-shaped injection valve member, there is now a small boosting ratio (or small pressure-reducing ratio, depending on the choice of parameters) of:

$$i_1 = d_A^2/d_N^2.$$

During the opening of the needle-shaped injection valve member 9, it opens with the vertically upward movement of the first piston 12 and second piston 14. The opening force resulting from the pressure decrease at the nozzle seat initially acts on the piezoelectric actuator 8 only via the smaller piston diameter $d_A$ of the first piston 12. The decrease of pressure on the injection valve member 9 in the region of the nozzle seat and the resulting opening force allow the piezoelectric actuator 8 to control the movement of the needle-shaped injection valve member 9. Only after the collar 26 of the second piston 14 comes into contact with the lower end surface of the prestroke sleeve 13 does the boosting ratio change to:

$i_2 = d_V^2/d_N^2$, where $d_V$=diameter of prestroke sleeve 13 and $d_N$=diameter of injection valve member 9.

The second boosting ratio $i_2$ is greater than the first boosting ratio $i_1$. To open the needle-shaped injection valve member 9 further, the voltage applied to the piezoelectric actuator 8 must first be further reduced since the piezoelectric actuator 8 retracts the prestroke sleeve 13 from the control chamber 20. To open the needle-shaped injection valve member 9 further, the voltage applied to the piezoelectric actuator 8 is first reduced further since the piezoelectric actuator 8 retracts the prestroke sleeve 13 from the control chamber 20 and since the pressure in the control chamber 20 is lower than the system pressure, i.e. rail pressure. However, to completely open the injection valve member 9 it is now only necessary for the piezoelectric actuator 8 to execute a short stroke motion since it is now possible to select a large boosting ratio $i_2$. If, however, only a small injection quantity is to be delivered to the combustion chamber of an auto ignition engine, then the injection valve member 9 advantageously continues to rest against the prestroke stop until the voltage is increased again in order to close the injection valve member 9.

FIG. 1.2 schematically shows that the injection valve member 9 has the seat diameter $d_S$ in the region of its seat at the combustion chamber end of the nozzle body 3.

Figure 2:
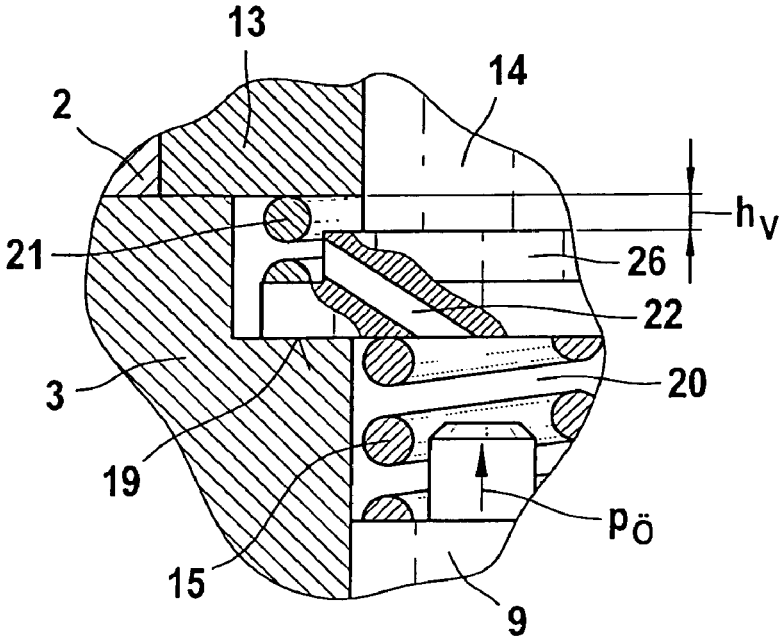
FIG. 2 shows an additional sleeve encompassing a prestroke sleeve from FIG. 1 in order to compensate for radial assembly tolerances.
Figure 2:
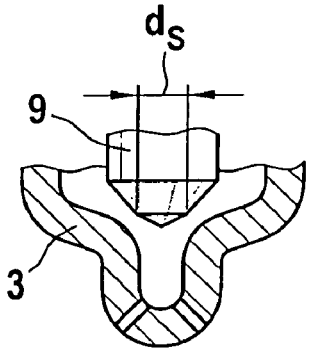
Figure 2:
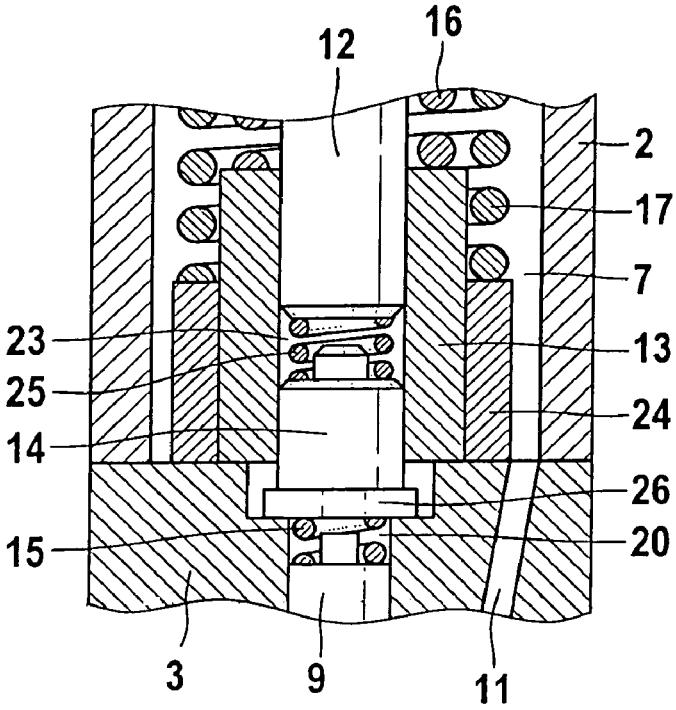

FIG. 2 shows an embodiment variant of this variable actuator stroked boosting proposed according to the invention in which the prestroke sleeve 13 is encompassed by an additional sleeve 24. The injector body 2, the prestroke sleeve 13, and the additional sleeve 24 rest against the upper flat surface of the nozzle body 3. The embodiment variant shown in FIG. 2 makes it possible to compensate for assembly tolerances in the radial direction. FIG. 2 does not show the retaining sleeve 4 that attaches the nozzle body 3 to the injector body 2.

By contrast with the embodiment variant shown in FIG. 1, the additional spring element 21 that positions the second piston 14 has been eliminated. FIG. 2 clearly shows that instead, the spring element 25 that positions the second piston 14 is now integrated into the hydraulic coupling chamber 23. Analogous to the variant of the embodiment proposed according to the invention shown in FIG. 1, the hydraulic coupling chamber 23 is delimited by the inner cylindrical surface of the prestroke sleeve 13 and the end surfaces of the first piston 12 and second piston 14. The spring element 25 integrated into the hydraulic coupling chamber 23 can be centered on a pin provided on the end surface of one of the pistons 12 or 14.

Whereas in the embodiment variant shown in FIG. 1, the outer spring element 17 rests directly against the injector body 2, in the embodiment variant shown in FIG. 2, the outer spring element 17 presses the additional sleeve 24 against the upper flat surface of the nozzle body 3. For the sake of completeness, it should be noted that the spring element 25 contained in the hydraulic coupling chamber 23 acts on the second piston 14 so that its collar 26 is pressed against a flat surface in the nozzle body 3. Analogous to the depiction in FIG. 1, the control chamber 20 contains the control chamber spring element 15 that acts on the injection valve member 9.

Figure 3:
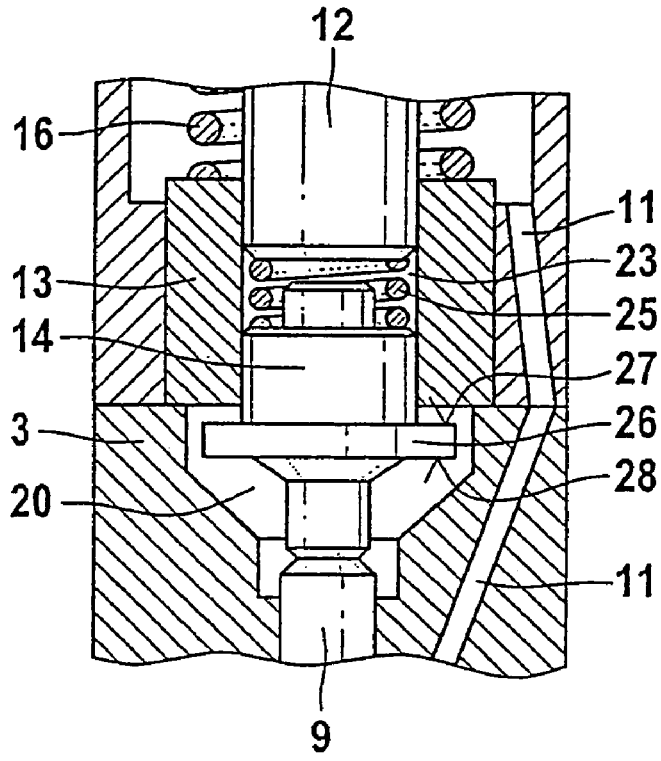
FIG. 3 shows an embodiment variant with an altered support position of one of the two booster pistons.

FIG. 3 shows another embodiment variant of the device for variable boosting of the actuator stroke.

Whereas in the embodiment variants shown in FIGS. 1 and 2, the piston end surface 19 or the collar 26 of the second piston 14 rests against the nozzle body 3, in the embodiment variant according to FIG. 3, the second piston 14 can also rest against the injection valve member 9. To that end, a pin-shaped extension is provided underneath the collar 26 and can rest against the upper end of the needle-shaped injection valve member 9. The collar 26 has an upper support surface 27 oriented toward the lower end of the prestroke sleeve 13 and a lower support surface 28 oriented toward the needle-shaped injection valve member 9. In the embodiment variant according to FIG. 3 as well, the inner spring element 16 acts on the prestroke sleeve 13. Also in the embodiment variant according to FIG. 3, the spring element 25 is contained inside the hydraulic coupling chamber 23 between the first piston 12 and the second piston 14 and can optionally be centered by a pin.

Figure 4:
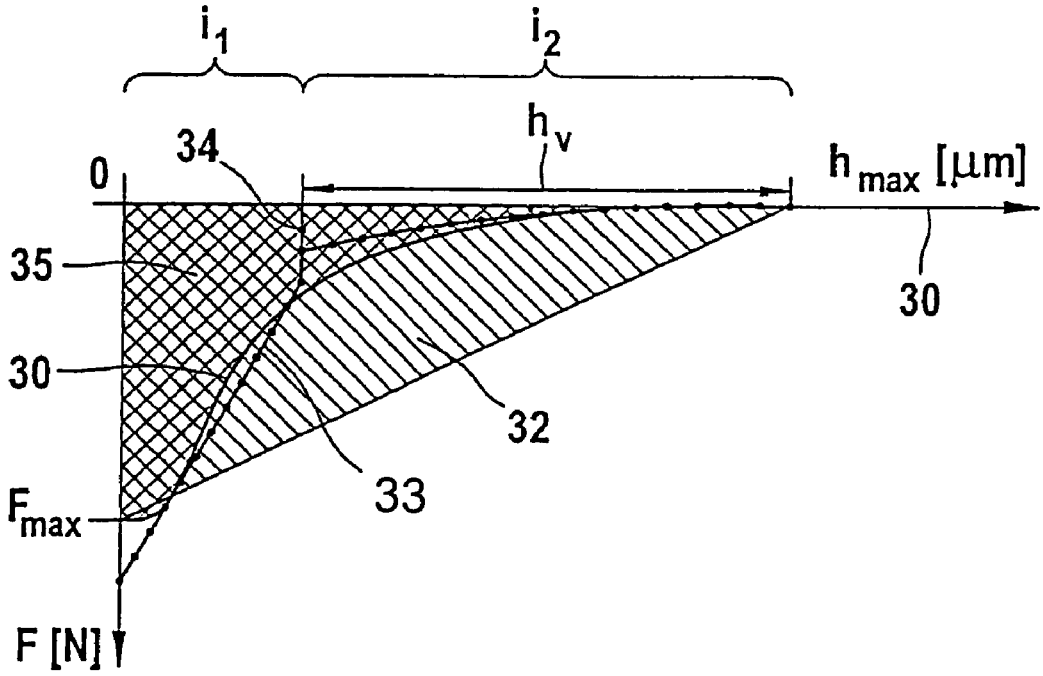
FIG. 4 shows the forces and strokes of the piezoelectric actuator that can be achieved by the stepped boosting in comparison to those of an actuation system without a stepped boosting.

FIG. 4 shows the actuator forces and actuator strokes that can be achieved by means of the stepped boosting compared to the forces and strokes of a system without stepped boosting.

Reference numeral 30 indicates the stroke curve of the injection valve member 9, $h_{max}$ indicates the maximum stroke path of the injection valve member 9 inside the nozzle body 3, and $h_v$ indicates the definite distance between the collar 26 on the second piston 14 and the lower end of the prestroke sleeve 13. $F_{max}$ indicates the maximum force that the piezoelectric actuator 8 must exert in order to lift the needle-shaped injection valve member 9 away from the nozzle seat. According to the force/stroke curve 33 of the piezoelectric actuator 8 with stepped boosting shown in FIG. 4, the force to be exerted by the piezoelectric actuator 8 continuously falls until the distance $h_V$ is reached, at which it has fallen to one fourth the maximum force $F_{max}$; until this distance $h_V$ is reached, the boosting ratio is $i_1$. FIG. 4 also shows that from the point at which the definite distance $h_V$ is reached to the maximum open position of the injection valve member, position $h_{max}$, the piezoelectric actuator 8 only has to exert a slight actuation force. The force to be exerted by the piezoelectric actuator 8 has a degressive curve. Reference numeral 33 is used below to indicate the force/stroke characteristic curve of the piezoelectric actuator 8 with stepped boosting proposed according to the present invention. Until the distance $h_V$ is reached, i.e. the distance indicated in FIG. 1 and Detail X (FIG. 1.1) between the collar 26 of the second piston 14 and the lower end surface of the prestroke sleeve 13, the force/stroke characteristic curve 33 is approximately linear, with a steep slope and then once the distance $h_V$ is reached, it extends in a linear fashion again, but now with a significantly less steep slope.

The foregoing relates to a preferred exemplary embodiment of the invention, it being understood that other variants and embodiments thereof are possible within the spirit and scope of the invention, the latter being defined by the appended claims.

The invention claimed is:

1. A fuel injector for injecting fuel into the combustion chamber of an internal combustion engine, the injector comprising an injection valve member that is directly actuatable by a piezoelectric actuator, the injection valve member being contained in a nozzle body, and moved into a closed position by a spring element, and a hydraulic boosting device between the piezoelectric actuator and the injection valve member, the hydraulic boosting device adapting the force exerted by the piezoelectric actuator to the opening force of the injection valve member, the hydraulic boosting device comprising a first piston and a second piston that are hydraulically coupled to each other by a coupling chamber, wherein a cross-sectional area of each of the first piston, the second piston, and the coupling chamber are the same.

2. The fuel injector according to claim 1, wherein the boosting device includes a sleeve-shaped guide body, the sleeve-shaped guide body encompassing the first and second pistons and the hydraulic coupling chamber.

3. The fuel injector according to claim 2, wherein the sleeve-shaped guide body is encompassed by an additional sleeve.

4. A fuel injector for injecting fuel into the combustion chamber of an internal combustion engine, the injector comprising an injection valve member that is directly actuatable by a piezoelectric actuator, the injection valve member being contained in a nozzle body, and moved into a closed position by a spring element, and a hydraulic boosting device between the piezoelectric actuator and the injection valve member, the hydraulic boosting device adapting the force exerted by the piezoelectric actuator to the opening force of the injection valve member, wherein the boosting device includes a sleeve-shaped guide body and further comprising an inner spring element that rests against the piezoelectric actuator and prestresses the sleeve-shaped guide body.

5. A fuel injector for injecting fuel into the combustion chamber of an internal combustion engine, the injector comprising an injection valve member that is directly actuatable by a piezoelectric actuator, the injection valve member being contained in a nozzle body, and moved into a closed position by a sprint element, and a hydraulic boosting device between the piezoelectric actuator and the injection valve member, the hydraulic boosting device adapting the force exerted by the piezoelectric actuator to the opening force of the injection valve member, wherein the boosting device comprises a first piston and a second piston that are hydraulically coupled to each other by a coupling chamber, wherein the boosting device includes a sleeve-shaped guide body, and further comprising an inner spring element that rests against the piezoelectric actuator and prestresses the sleeve-shaped guide body.

6. A fuel injector for injecting fuel into the combustion chamber of an internal combustion engine, the injector comprising an injection valve member that is directly actuatable by a piezoelectric actuator, the injection valve member being contained in a nozzle body, and moved into a closed position by a sprint element, and a hydraulic boosting device between the piezoelectric actuator and the injection valve member, the hydraulic boosting device adapting the force exerted by the piezoelectric actuator to the opening force of the injection valve member, wherein the boosting device comprises a first piston and a second piston that are hydraulically coupled to each other by a coupling chamber and wherein one piston of the boosting device is acted on by an additional spring element contained in a hydraulic chamber of the nozzle body, by a control chamber spring element contained in the control chamber, and a spring element contained in the coupling chamber.

7. The fuel injector according to claim 6, wherein the hydraulic chamber, which is contained in the nozzle body, and the control chamber are hydraulically connected to each other via a flow connection in the second piston.

8. The fuel injector according to claim 7, wherein the flow connection is embodied in the form of a connecting bore or groove.

9. A fuel injector for injecting fuel into the combustion chamber of an internal combustion engine, the injector comprising an injection valve member that is directly actuatable by a niezoelectric actuator, the injection valve member being contained in a nozzle body, and moved into a closed position by a spring element, and a hydraulic boosting device between the piezoelectric actuator and the injection valve member, the hydraulic boosting device adapting the force exerted by the piezoelectric actuator to the opening force of the injection valve member, wherein once an opening pressure $P_O$ of the injection valve member has been reached, the boosting device acts with a first boosting ratio $i_1=d_A^2/d_N^2$, where $d_A$ is the diameter of the first piston and $d_N$ is the diameter of the injection valve member.

10. A fuel injector for injecting fuel into the combustion chamber of an internal combustion engine, the injector comprising an injection valve member that is directly actuatable by a piezoelectric actuator, the injection valve member being contained in a nozzle body, and moved into a closed position by a spring element, and a hydraulic boosting device between the piezoelectric actuator and the injection valve member, the hydraulic boosting device adapting the force exerted by the piezoelectric actuator to the opening force of the injection valve member, wherein one piston comprises a collar, and wherein, when the collar is resting against the sleeve-shaped guide body, the boosting device acts with the boosting ratio $i_2=d_V^2$, where $d_V$ is the diameter of the sleeve-shaped guide body and $d_N$ is the diameter of the injection valve member.

11. A fuel injector for injecting fuel into the combustion chamber of an internal combustion engine, the injector comprising an injection valve member that is directly actuatable by a piezoelectric actuator, the injection valve member being contained in a nozzle body, and moved into a closed position by a spring element, and a hydraulic boosting device between the piezoelectric actuator and the injection valve member, the hydraulic boosting device adapting the force exerted by the piezoelectric actuator to the opening force of the injection valve member, wherein the boosting device comprises a first piston and a second piston that are hydraulically coupled to each other by a coupling chamber and wherein, in its neutral position, the second piston of the boosting device is either supported with its piston end surface against a flat surface of the nozzle body or supported with a pin directly against the injection valve member.

* * * * *